US005832623A

United States Patent [19]

Nagumo et al.

[11] Patent Number: 5,832,623

[45] Date of Patent: Nov. 10, 1998

[54] DIRT DRYING PROCESSING EQUIPMENT

[75] Inventors: Shinichi Nagumo, Tokyo; Shouichi Uemura, Sapporo; Masaaki Saitou, Kyoto, all of Japan

[73] Assignee: Nissan Motor Co., Ltd., Kanagawa, Japan

[21] Appl. No.: 770,580

[22] Filed: Dec. 19, 1996

[30] Foreign Application Priority Data

Dec. 28, 1995 [JP] Japan ..... 7-343613

[51] Int. Cl.[6] ..... F26B 13/26

[52] U.S. Cl. ..... 34/95; 4/111.1

[58] Field of Search ..... 4/111.1; 34/60, 34/95

[56] References Cited

U.S. PATENT DOCUMENTS 5,058,213 10/1991 Kishi et al. ..... 34/95

5,230,164 7/1993 Kishi ..... 34/60

5,257,466 11/1993 Kishi ..... 34/95

FOREIGN PATENT DOCUMENTS 2-40280 2/1990 Japan .

7-136640 5/1995 Japan .

*Primary Examiner*—Ronald C. Capossela

*Attorney, Agent, or Firm*—McDermott, Will & Emery

[57] ABSTRACT

A dirt drying processing equipment is constructed so that hot air out of a hot-air generator is blown into dirt in a drying reservoir through a hot-air supply pipe having a pointed end opened to the bottom of the drying reservoir, vaporizing water contained in the dirt. Solid matter or evaporation residue of dirt is blown by hot air to a cyclone where it is separated therefrom for disposal.

18 Claims, 9 Drawing Sheets

DIRT DRYING PROCESSING EQUIPMENT

BACKGROUND OF THE INVENTION

The present invention relates generally to an art of drying and processing dirt such as excreta and more particularly, to a dirt drying processing equipment which is useful at construction sites, event grounds, devastated sites, and mountain tourist establishments with less traffic facilities.

As for known dirt drying processing equipment, JP-A 2-40280 discloses excreta drying equipment which is provided with a drying cauldron accommodated in an outer casing. Agitating vanes are operated to agitate excreta injected in the drying cauldron together with heat accumulating balls of ceramics or stainless steel previously put therein while hot air out of an oil or gas burner is supplied to a space between the outer casing and the drying cauldron through a burner pipe, vaporizing water contained in the excreta.

JP-A 7-136640 discloses an excreta processing equipment which includes a rotary drying cauldron, metallic agitating balls accommodated therein, baffle poles for preventing free movement of the agitating balls, and a heating unit provided with a high-frequency coil. The drying cauldron is rotated to agitate the excreta with the agitating balls while the heating unit is operated to electromagnetically heat the drying cauldron and the agitating balls, vaporizing water contained in the excreta. Then, solid matter or evaporation residue accumulating in the drying cauldron is absorbed and removed by a vacuum dust collector.

Uniform heating of the entire bottom of the drying cauldron is difficult with the excreta drying equipment as disclosed in JP-A 2-40280. Since excreta in the drying cauldron is heated from an outside bottom thereof by hot air out of the burner, the heat efficiency is extremely low even with a partial recovery of heat by blowing into the drying cauldron air which passed through a heat-exchanger pipe arranged around an upper portion of the drying cauldron. Additionally, this equipment needs a fan for discharging hot air and a blower for blowing air into the drying cauldron through the heat-exchanger pipe, causing an inevitable enlargement of size. Furthermore, the inside of the drying cauldron should be cleaned on a frequent basis so as to remove a solid matter or evaporation residue accumulating therein.

With the excreta processing equipment as disclosed in JP-A 7-136640, the vacuum dust collector is arranged to remove solid matter or evaporation residue accumulating in the drying cauldron, resulting in a reduction in the need for maintenance such as periodic cleaning of the drying cauldron. However, due to fixed insertion position of a cleaning pipe, it is difficult to fully remove solid matter or evaporation residue widely dispersed on the bottom of the drying cauldron. Moreover, efficient heating of the bottom and sides of the drying cauldron by electromagnetic heating requires a large electric capacity, causing an enlargement of the heating unit, resulting in an inevitable complication and enlargement of the entire system including the dust collector, discharge system for discharging vapor in the drying cauldron, elevating mechanism for inserting, after a drying process, the cleaning pipe of the dust collector into the drying cauldron.

It is, therefore, an object of the present invention to provide a dirt drying processing equipment which enables, with simple construction and excellent heat efficiency, speedy evaporation of water contented in the dirt, and easy collection of solid evaporation residue.

SUMMARY OF THE INVENTION

According to one aspect of the present invention, there is provided an equipment for drying and processing dirt. The equipment includes:

a first reservoir for receiving dirt with solid matter;

a generator generating hot air;

a supply pipe having one end connected to said generator and another end with an opening located in the vicinity of a bottom of said first reservoir;

a discharge pipe having one end connected to an upper portion of said first reservoir and another end;

a cyclone connected to said another end of said discharge pipe, said cyclone serving to separate said solid matter of dirt contained in hot air out of said discharge pipe;

a deodorizer connected to said cyclone; and a second reservoir connected to said cyclone, said second reservoir serving to collect said solid matter of dirt separated by said cyclone.

Another aspect of the present invention lies in providing an equipment for drying and processing dirt. The equipment includes:

means for receiving dirt with solid matter;

means for generating hot air;

means for conveying hot air, said conveying means having one end connected to said generating means and another end with an opening located in the vicinity of a bottom of said receiving means;

means for discharging hot air, said discharging means having one end connected to an upper portion of said receiving means and another end;

means connected to said another end of said discharging means for separating said solid matter of dirt contained in hot air out of said discharging means;

means connected to said separating means for deodorizing hot air out of said separating means; and means connected to said separating means for collecting said solid matter of dirt separated by said separating means.

DETAILED DESCRIPTION OF THE INVENTION

Figure 1:
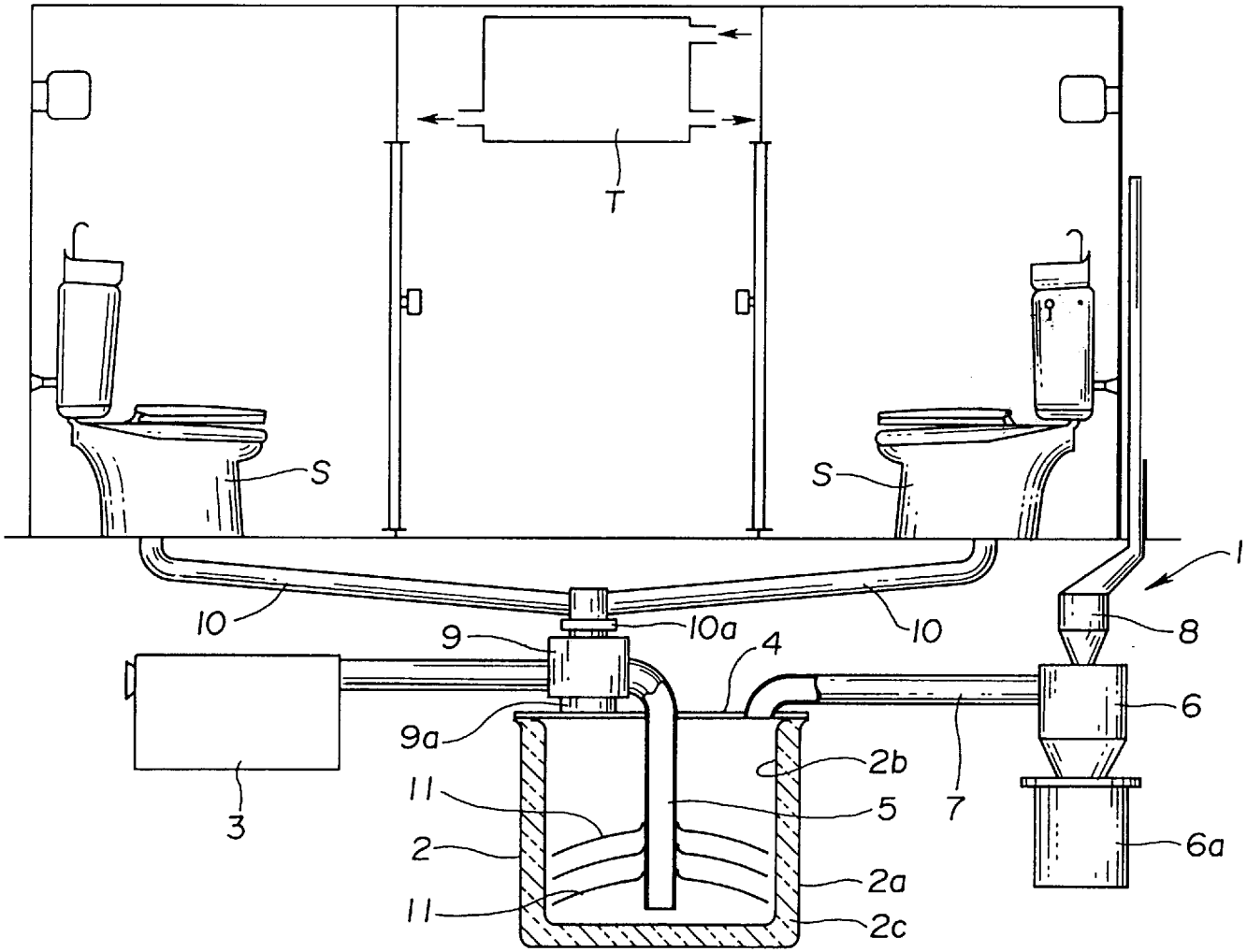
FIG. 1 is a diagrammatic view showing a first preferred embodiment of a dirt drying processing equipment according to the present invention.

Referring to the drawings wherein like reference numerals designate like parts throughout the views, a description will be made with regard to preferred embodiments of a dirt drying processing equipment according to the present invention.

Figure 2:
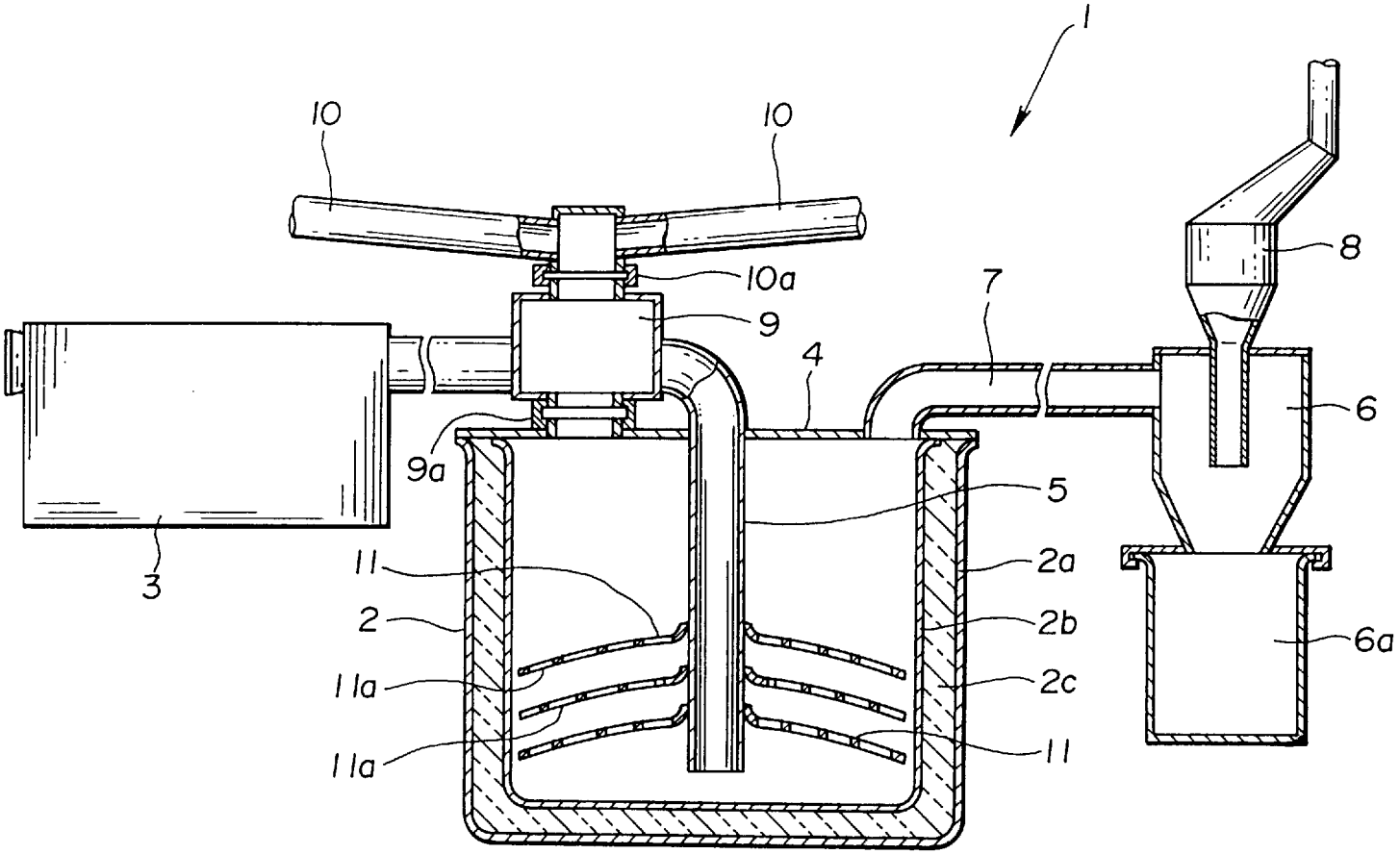
FIG. 2 is an enlarged fragmentary view of FIG. 1.

FIGS. 1–3 show a first embodiment of the present invention wherein dirt drying processing equipment 1 serves to process excreta in temporary toilets. Referring to FIG. 1, the dirt drying processing equipment 1 includes a drying reservoir 2 for receiving dirt or excreta to be processed, a hot-air generator 3, a hot-air supply pipe 5 having one end connected to the hot-air generator 3 and another end arranged through a cover 4 of the drying reservoir 2 to introduce therein hot air generated by the hot-air generator 3. The dirt drying processing equipment 1 further includes a cyclone 6 for separating a powdered solid matter of excreta contained in hot air, a discharge pipe 7 mounted to the cover 4 for ensuring fluid communication between the drying reservoir 2 and the cyclone 6, a deodorizer 8 connected to an outlet of the cyclone 6, and a collecting reservoir 6*a* detachably mounted to a bottom of the cyclone 6 for accumulating a solid matter of excreta separated thereby.

As seen in FIG. 2, in addition to the hot-air supply pipe 5 and the discharge pipe 7 as described above, a temporary storage reservoir 9 of dirt is connected to the cover 4 of the drying reservoir 2 through an inflow-port valve 9*a*. When the inflow-port valve 9*a* is opened, dirt in the temporary storage reservoir 9 flows into the drying reservoir 2. Referring also to FIG. 1, the temporary storage reservoir 9 is connected to a toilet bowl S in the temporary toilets through a dirt inflow pipe 10 and a shutoff valve 10*a*.

The drying reservoir 2 is insulated by a heat insulating material 2*c* such as glass wool and rock wool interposed between casing and lining materials 2*a*, 2*b* of heat resisting steel or stainless steel.

The hot-air supply pipe 5 arranged through the cover 4 of the drying reservoir 2 to extend to a bottom thereof has a pointed end opened in the vicinity of the bottom of the drying reservoir 2, and provided with three heat-transfer plates 11 to increase the contact area with dirt for improvement of the heat transfer efficiency.

Figure 3A:
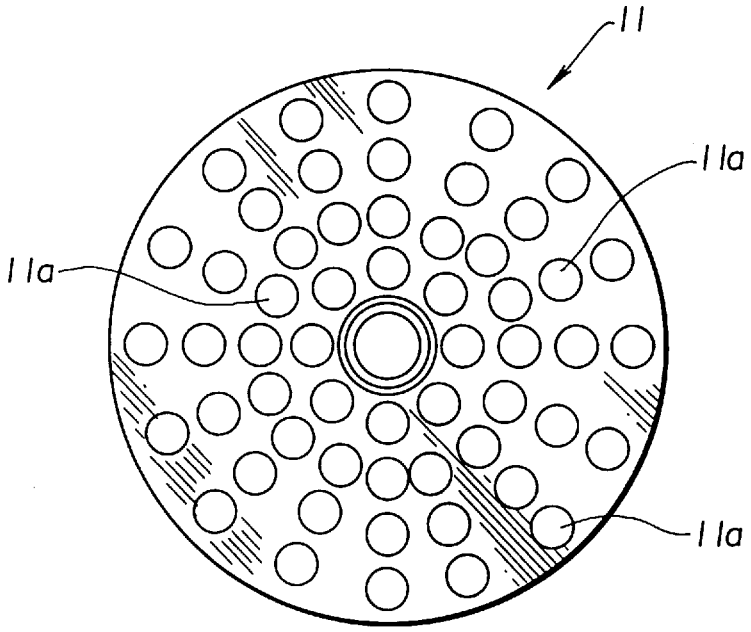
FIG. 3A is a plan view showing a heat-transfer plate.
Figure 3B:
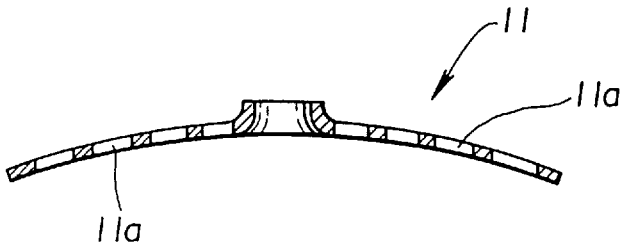
FIG. 3B is a sectional view showing the heat transfer plate.

Referring to FIGS. 3A and 3B, each heat-transfer plate 11 includes a disc of stainless steel curved like a spherical surface and having a plurality of through holes 11*a*. It is noted that the heat-transfer plates 11 are mounted to the hot-air supply pipe 5 so that the through holes 11*a* of the adjacent heat-transfer plates 11 do not overlap with each other.

The deodorizer 8 includes a catalyst such as platinum. Hot air which passed through the dirt is introduced therein to decompose malodorous components such as skatole and mercaptan, then released in the atmosphere.

In the first embodiment, the hot-air generator 3 includes a portable micro-gas-turbine generator (100 V, 2.6 kW) manufactured by Nissan Motor Co., Ltd. During operation, the heat efficiency is decreased to increase the temperature of hot air up to approximately 500° C.

Next, processing of dirt in the dirt drying processing equipment 1 will be described.

Dirt in the toilet bowl S is transmitted, together with flush water in a flush tank T, to the temporary storage reservoir 9 via the dirt inflow pipe 10. At this time, the shutoff valve 10*a* is open, and the inflow-port valve 9*a* is closed.

When a predetermined amount of dirt accumulates in the temporary storage reservor 9, the inflow-port valve 9*a* is opened to allow dirt to flow into the drying reservoir 2.

When a water-level sensor, not shown, senses that the amount of dirt in the drying reservoir 2 arrives at a predetermined level where the pointed end of the hot-air supply pipe 5 and the three heat-transfer plates 11 are immersed in dirt, the hot-air generator 3 starts to blow hot air directly into dirt via the hot-air supply pipe 5. In case of such flush toilet, since the amount of dirt in the drying reservoir 2 is practically determined by the amount of flush water, the number of flushes can be counted to determine the start of the hot-air generator 3 in place of the use of the water-level sensor.

Hot air supplied to the drying reservoir 2 via the hot-air supply pipe 5 serves to heat dirt directly in the form of bubbles, or indirectly through the heat-transfer plates 11 of the hot-air supply pipe 5, vaporizing a water content of dirt. At this time, as described above, since the heat-transfer plates 11 are arranged so that the through holes 11*a* of adjacent two thereof do not overlap with each other, rising bubbles are obstructed by the heat-transfer plates 11 to contact dirt for a relatively long time, resulting in improved heat transfer efficiency.

After evaporation of a water content of dirt, solid matter or evaporation residue is further heated by hot air of higher temperature, and oxidized to ashes. Part of the ash is blown away by hot air to move between the heat-transfer plates 11, and is reduced to finer powder.

An ashed or powdered solid matter or evaporation residue is blown by hot air via the discharge pipe 7 to the cyclone 6 where it is separated from a current of hot air, and accumulated in the collecting reservoir 6a of the cyclone 6 for disposal.

Hot air with solid matter removed by the cyclone 6 is introduced into the deodorizer 8 to decompose malodorous components contained therein through catalytic action, then released in the atmosphere.

When detection of the temperature in the drying reservoir 2 or in the discharge pipe 7 reveales that the temperature exceeds a predetermined value, and continues over a predetermined period of time, processing of dirt is considered to be finished, so that the hot-air generator 3 stops, and stands by for next operation.

Figure 4:
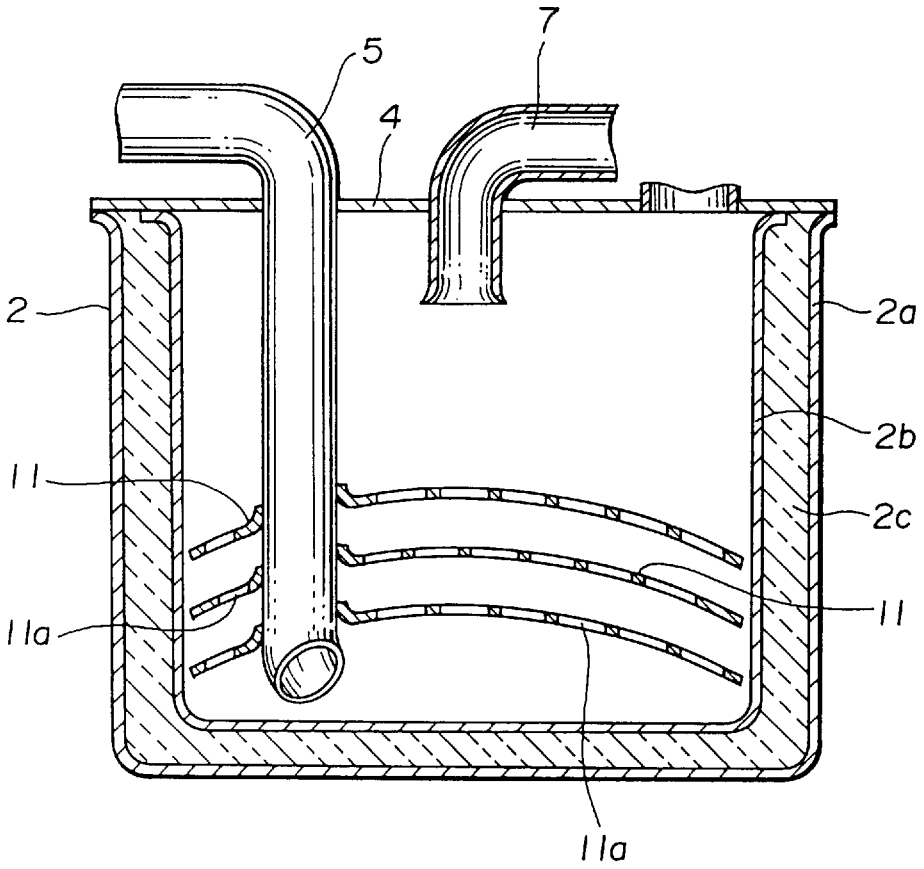
FIG. 4 is a view similar to FIG. 3B, showing another example of arrangement of a hot-air supply pipe and a discharge pipe in a drying reservoir.

FIG. 4 shows another example of an arrangement of the hot-air supply pipe 5 and the discharge pipe 7 in the drying reservoir 2. In the first embodiment, as seen in FIG. 2, the hot-air supply pipe 5 is arranged substantially in the middle of the drying reservoir 2, having a blowoff opening directly facing the bottom thereof. Alternatively, referring to FIG. 4, the hot-air supply pipe 5 may be arranged in a peripheral position of the drying reservoir 2, having a blowoff opening facing the bottom thereof slantwise, e.g. 45°. In this case, the discharge pipe 7 is arranged in the center of the cover 4 of the drying reservoir 2, and the heat-transfer plates 11 are eccentrically mounted to the hot-air supply pipe 5.

Such structure allows hot air blown into the drying reservoir 2 to circle therein like a cyclone, resulting in not only efficient heat transfer to the dirt, but quick discharge of fine particles ashed or powdered solid matter or evaporation residue to the cyclone 6 through the discharge pipe 7 arranged in the middle of the drying reservoir 2. In this case, the center of the cover 4, i.e. the outer periphery of a discharge-pipe mounting portion thereof, is preferably formed like a cone.

Figure 5:
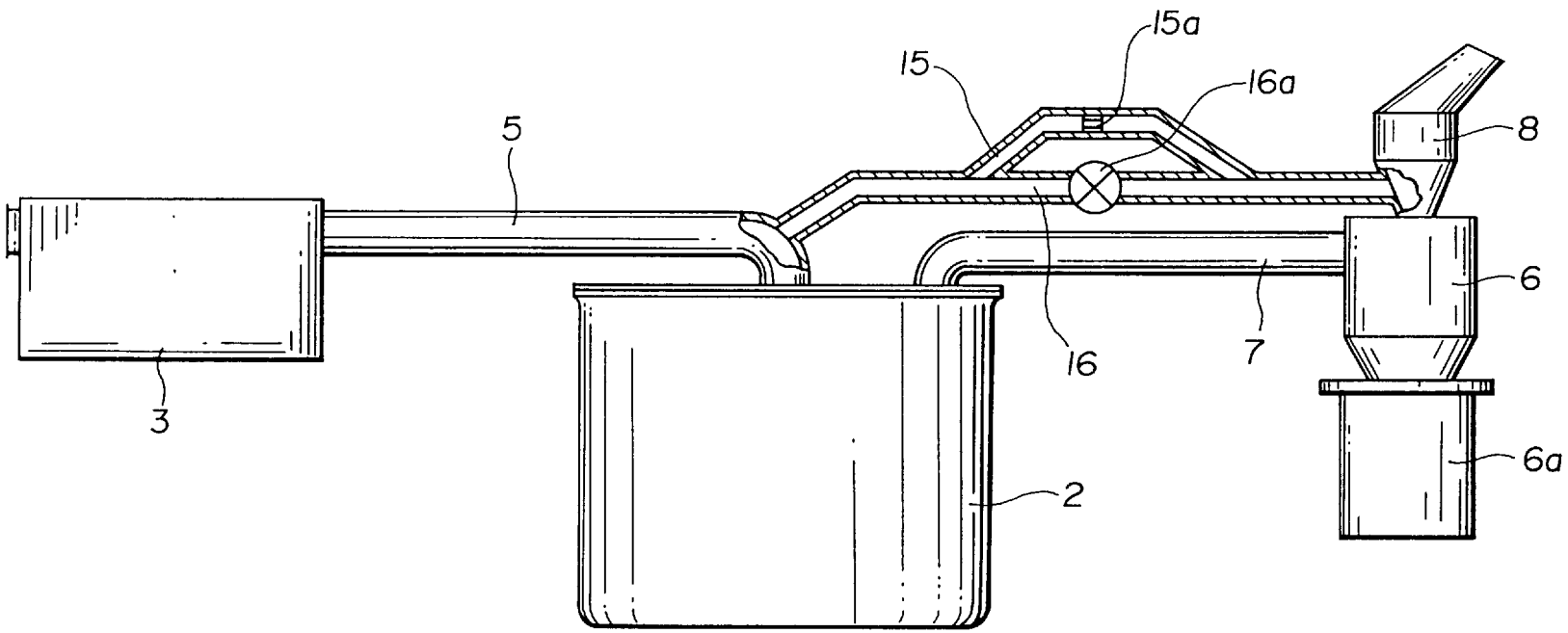
FIG. 5 is a view similar to FIG. 1, showing an example of a bypass connecting a hot air generator and a deodorizer.

Moreover, the dirt drying processing equipment according to the present invention may include a bypass for directly connecting the hot-air generator 3 and the deodorizer 8 so as to heat the catalyst received in the deodorizer 8 for activation at all times. Specifically, referring to FIG. 5, the bypass includes first and second bypass portions 15, 16 interposed between an elbow of the hot-air supply pipe 5 immediately before the drying reservoir 2 and the deodorizer 8.

The first bypass portion 15 is arranged to detour around a valve 16*a* of the second bypass portion 16, and is provided with an orifice 15*a*. Thus, regardless of opening and closing of the valve 16*a*, a part of hot air out of the hot-air generator 3 is always supplied to the deodorizer 8 via the first bypass portion 15 so as to always keep the catalyst in the high-temperature or activated state, enabling full decomposition of malodorous components contained in hot air.

When the valve 16*a* of the second bypass portion 16 is open, hot air out of the hot-air generator 3 is supplied to the deodorizer 8, and not to the drying reservoir 2 so as to blow into dirt. Thus, opening of the valve 16*a* up to a lapse of a predetermined period of time after start of the hot-air generator 3 means that drying of dirt starts practically after the catalyst of the deodorizer 8 is fully heated, resulting in no release of malodorous components in the atmosphere without being decomposed. The valve 16*a* may include a motor-operated valve to allow automatic opening closing control thereof connected with a timer.

Figure 6:
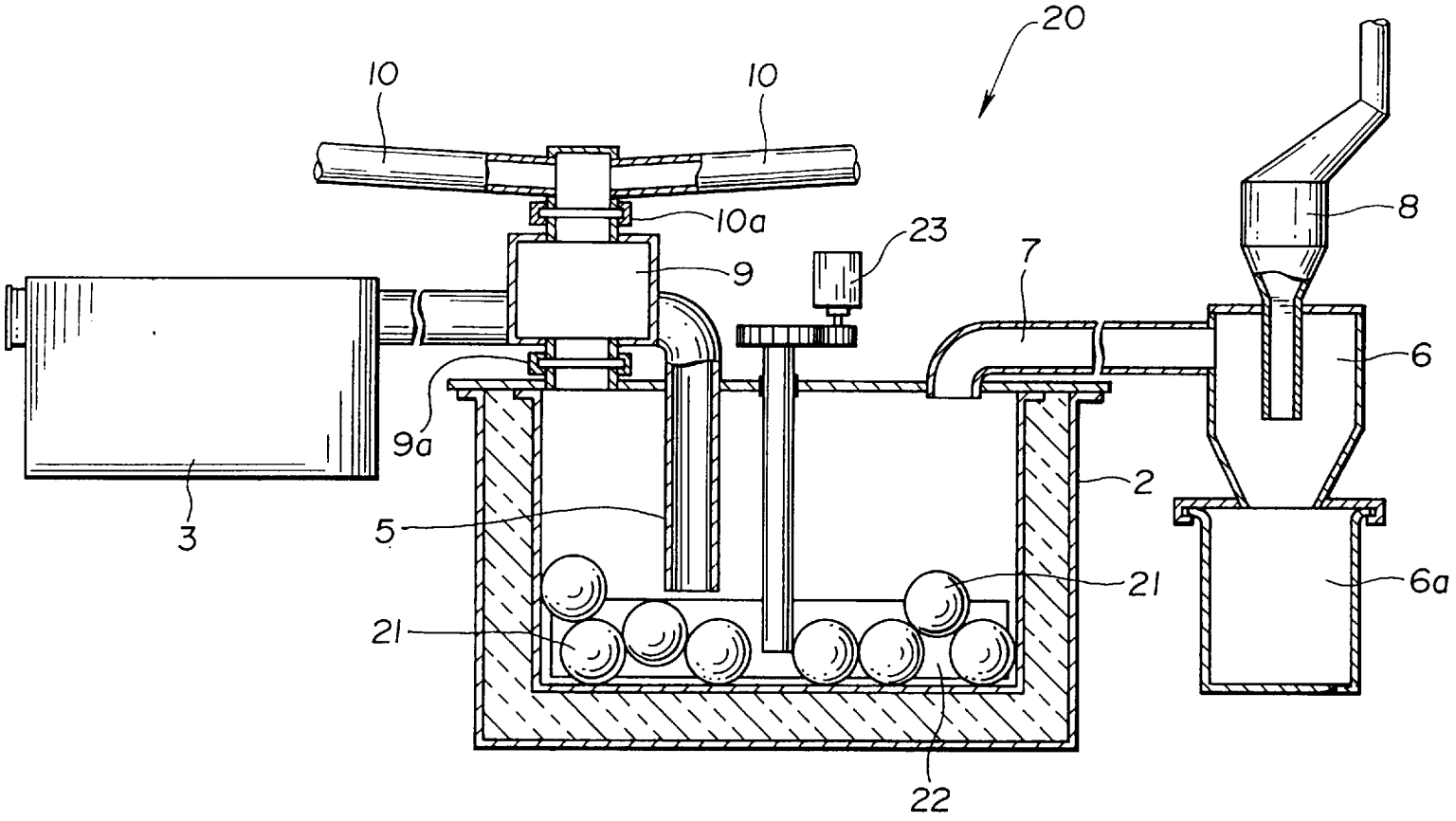
FIG. 6 is a view similar to FIG. 5, showing a second preferred embodiment of the present invention.

FIG. 6 shows a second embodiment of the present invention. The second embodiment is substantially the same in structure as the first embodiment except that the dirt drying processing equipment 20 includes heat accumulating balls 21 of ceramics or metal such as stainless steel put in a drying reservoir 2 in place of the heat-transfer plates 11, and a motor 23 for rotating agitating vanes 22 for agitating dirt in the drying reservoir 2 together with the heat accumulating balls 21. In the same way as in the first embodiment in FIG. 1, the dirt drying processing equipment 20 includes a dirt inflow pipe 10 connected to the toilet bowl S in the temporary toilets.

In the same way as in the first embodiment, in the second embodiment with the dirt drying processing equipment 20, when dirt injected in the drying reservoir 2 arrives at a predetermined level, a hot-air generator 3 starts to blow hot air directly into dirt, vaporizing water contained therein.

When water contained in the dirt is reduced to a certain extent, the motor 23 is operated to rotate the agitating vanes 22, agitating dirt together with the heat accumulating balls 21. This serves to accelerate evaporation of water contained in the dirt, and to crush dried solid matter or evaporation residue into finer pieces or powder.

Solid matter powdered by crushing or ashed by hot air is blown by hot air to a cyclone 6 where it is separated therefrom, and accumulated in a collecting reservoir 6*a* of the cyclone 6 for disposal.

Figure 7:
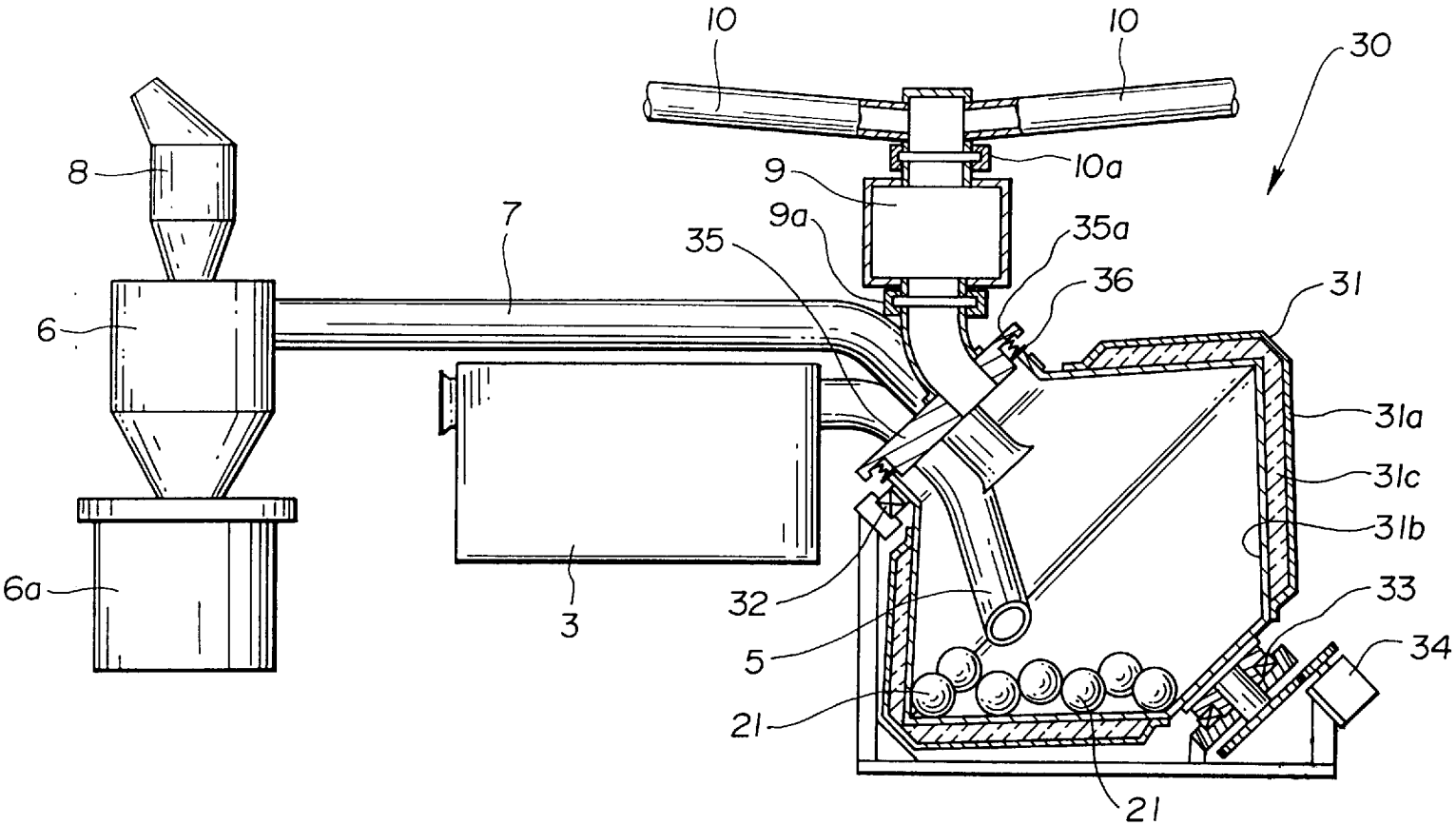
FIG. 7 is a view similar to FIG. 6, showing a third preferred embodiment of the present invention.

FIG. 7 shows a third embodiment of the present invention wherein agitation of dirt in a drying reservoir together with heat accumulating balls is carried out by rotation of the drying reservoir itself, and not by the agitating vanes 22 arranged therein.

Specifically, dirt drying processing equipment 30 includes a drying reservoir 31 having an external form like an elongated bead with two conical portions. In the same way as the drying reservoir 2 in the first and second embodiments, the drying reservoir 31 is insulated using a heat insulating material 31*c* interposed between casing and lining materials 31*a*, 31*b*. The drying reservoir 31 is supported by bearings 32, 33 to have a rotation axis inclined by approximately 45°, and is rotated by a motor 34.

A temporary storage reservoir 9 of dirt is connected to a cover 35 for covering an opening of the drying reservoir 31 through an inflow-port valve 9*a*. Moreover, a discharge pipe 7 and a hot-air supply pipe 5 are arranged through the cover 35 of the drying reservoir 31. The hot-air supply pipe 5 has a pointed end opened in the vicinity of the bottom of the drying reservoir 31. The cover 35 includes a spring 35*a* and a seal plate 36. The spring 35*a* serves to press the seal plate 36 to an edge of the opening of the drying reservoir 31, ensuring sealing between the cover 35 and the drying reservoir 31.

In the same way as in the first embodiment in FIG. 1, the temporary storage reservoir 9 is connected to the toilet bowl S in the temporary toilets through a dirt inflow pipe 10 and a shutoff valve 10*a*.

In the same way as in the first and second embodiments, in the third embodiment with the dirt drying processing equipment 30, when dirt injected in the drying reservoir 31 arrives at a predetermined level, a hot-air generator 3 starts to provide hot air which serves to heat dirt directly in the form of bubbles, or indirectly through the heat accumulating balls 21, vaporizing a water contained in the dirt.

When the amount of water contained in the dirt is reduced to a certain extent, e.g. The level of dirt is lower than that of the opened pointed end of the hot-air supply pipe 5, the motor 34 is operated to rotate the drying reservoir 31 at a predetermined speed, transmitting heat from the heat accumulating balls 21 and an inner wall of the drying reservoir 31 heated by hot air to dirt. This serves to accelerate evaporation of the water contained in the dirt, and to crush dried solid matter or evaporation residue into finer pieces or powder through rotation and fall of the heat accumulating balls 21 due to dead weight thereof.

Powdered or ashed solid matter is blown by hot air to a cyclone 6 where it is separated therefrom, and accumulated in a collecting reservoir 6*a* for appropriate disposal.

Figure 8:
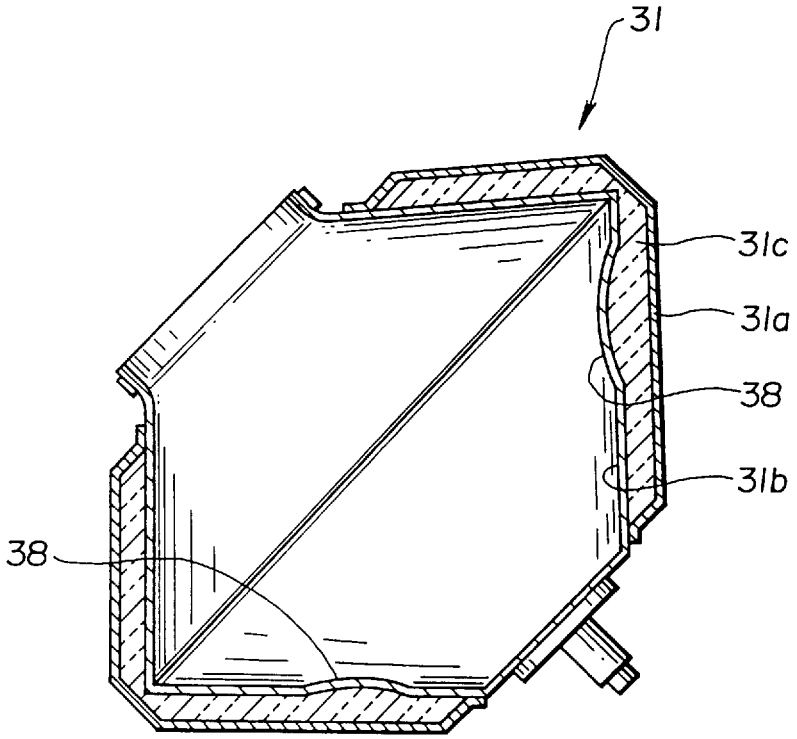
FIG. 8 is a view similar to FIG. 4, showing another example of the shape of a rotary drying reservoir.

In the third embodiment with the dirt drying processing equipment 30, the inner wall of the rotary drying reservoir 31 may be formed with irregularities. Specifically, referring to FIG. 8, the drying reservoir 31 includes protrusions 38 on the inner surface thereof, which make movement of the heat accumulating balls 21 random to produce irregular displacement locus thereof, improving the crushing efficiency of the solid matter of dirt, resulting in achievement of finer pieces.

Figure 9:
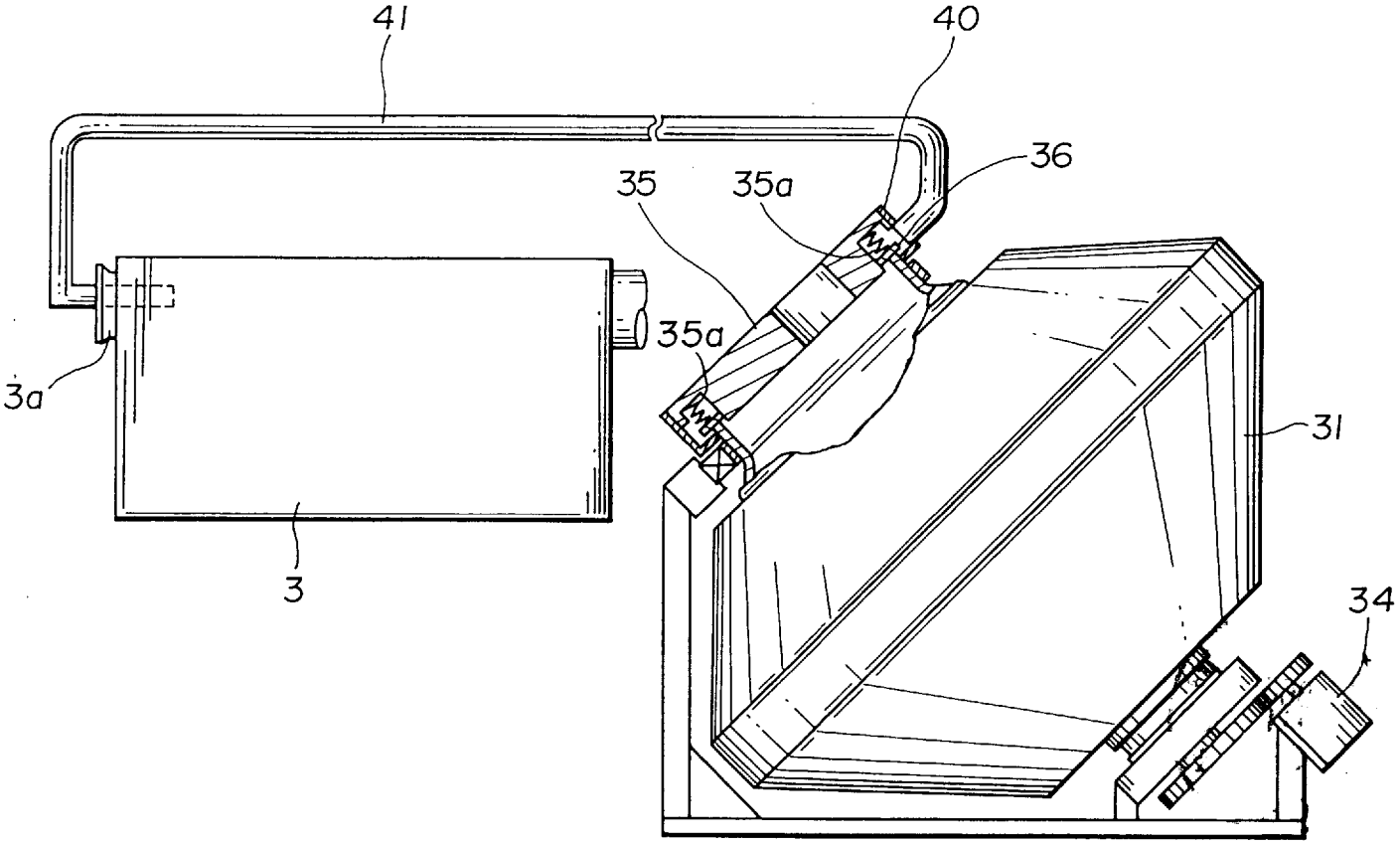
FIG. 9 is a view similar to FIG. 7, showing a cover seal and an intake pipe in the rotary drying reservoir.

Moreover, in the third embodiment with the dirt drying processing equipment 30, an intake pipe may be arranged between the seal portion disposed between the drying reservoir 31 and the cover 35 and the hot-air generator 3. Specifically, referring to FIG. 9, a seal cover 40 is arranged to the cover 35 at a slide portion thereof between the drying reservoir 31 and the seal plate 36, and an intake pipe 41 is arranged between the seal cover 40 and an air intake 3*a* of the hot-air generator 3.

As described above, sealing between the drying reservoir 31 and the cover 35 is ensured by the seal plate 36 through the spring 35*a*. If hot air leaks from the drying reservoir 31, gas containing malodorous components is led to the hot-air generator 3 through the intake pipe 41 and the air intake 3*a*, where it is heated again to circulate in the dirt drying processing equipment 30, effectively preventing diffusion of an offensive odor.

Having described the present invention in connection with the preferred embodiments, it is noted that the present invention is not limited thereto, and various changes and modifications can be made without departing from the spirit of the present invention.

What is claimed is:

1. An apparatus for drying and processing dirt, comprising:

a temporary storage reservoir receiving dirt with a solid matter, said temporary storage reservoir storing the dirt temporarily;

a first reservoir receiving dirt with a solid matter from said temporary storage reservoir;

a valve connecting said first reservoir and said temporary storage reservoir;

a generator generating hot air;

a supply pipe having one end connected to said generator and another end with an opening located in the vicinity of a bottom of said first reservoir;

a discharge pipe having one end connected to an upper portion of said first reservoir and another end;

a cyclone connected to said another end of said discharge pipe, said cyclone serving to separate said solid matter of dirt contained in hot air out of said discharge pipe;

a deodorizer connected to said cyclone; and a second reservoir connected to said cyclone, said second reservoir serving to collect said solid matter of dirt separated by said cyclone.

2. The apparatus as claimed in claim 1, wherein said first reservoir includes a heat insulating material.

3. The apparatus as claimed in claim 1, wherein said supply pipe is disposed substantially in the middle of said first reservoir.

4. The apparatus as claimed in claim 3, wherein said supply pipe is disposed in a peripheral position of said first reservoir.

5. The apparatus as claimed in claim 1, wherein said opening of said another end of said supply pipe faces directly said bottom of said first reservoir.

6. The apparatus as claimed in claim 5, wherein said opening of said another end of said supply pipe faces slantwise said bottom of said first reservoir.

7. The apparatus as claimed in claim 1, further comprising:

heat-transfer plates mounted to said another end of said supply pipe, said heat-transfer plates including a disc curved like a spherical surface, said heat-transfer plates being formed with through holes, respectively, said heat-transfer plates being arranged so that said through holes of adjacent heat transfer plates fail to overlap with each other.

8. The apparatus as claimed in claim 1, further comprising:

a bypass arranged between said generator and said deodorizer, said bypass including a first portion serving to supply a part of hot air out of said generator, and a second portion serving to supply hot air out of said generator up to a lapse of a predetermined period of time after start of said generator.

9. The apparatus as claimed in claim 1, further comprising:

heat accumulating balls received in said first reservoir; and means for moving said heat accumulating balls.

10. The apparatus as claimed in claim 9, wherein said heat accumulating balls are made of a material comprising ceramics or metal.

11. The apparatus as claimed in claim 9, wherein said moving means include agitating vanes and a motor.

12. The apparatus as claimed in claim 1, further comprising:

an intake pipe arranged between a cover of said first reservoir and an air intake of said generator.

13. The apparatus as claimed in claim 1, further comprising:

heat accumulating balls received in said first reservoir; and a device within said first reservoir for moving said heat accumulating balls.

14. The apparatus as claimed in claim 13, wherein said heat accumulating balls are made of a material comprising ceramics or metal.

15. The apparatus as claimed in claim 13, wherein said device includes agitating vanes and a motor.

16. An apparatus for drying and processing dirt, comprising:

a first reservoir receiving dirt with a solid matter, said first reservoir including a rotary reservoir having a rotation axis inclined with respect to a horizontal line;

a generator generating hot air;

a supply pipe having one end connected to said generator and another end with an opening located in the vicinity of a bottom of said first reservoir;

a discharge pipe having one end connected to an upper portion of said first reservoir and another end a cyclone connected to said another end of said discharge pipe, said cyclone serving to separate said solid matter of dirt contained in hot air out of said discharge pipe;

a deodorizer connected to said cyclone; and a second reservoir connected to said cyclone, said second reservoir serving to collect said solid matter of dirt separated by said cyclone.

17. The apparatus as claimed in claim 16, wherein said rotary reservoir of said first reservoir has an inner surface formed with irregularities.

18. An apparatus for drying and processing dirt, comprising:

means for storing dirt with a solid matter temporarily;

means for receiving dirt with a solid matter from said means for storing dirt temporarily;

means, interposed between said receiving means and said storing means, for controlling inflow of dirt to said receiving means;

means for generating hot air;

means for conveying hot air, said conveying means having one end connected to said generating means and another end with an opening located in the vicinity of a bottom of said receiving means;

means for discharging hot air, said discharging means having one end connected to an upper portion of said receiving means and another end;

means connected to said another end of said discharging means for separating said solid matter of dirt contained in hot air out of said discharging means;

means connected to said separating means for deodorizing hot air out of said separating means; and means connected to said separating means for collecting said solid matter of dirt separated by said separating means.

* * * * *